United States Patent [19]

Roebuck et al.

[11] Patent Number: 4,975,563

[45] Date of Patent: Dec. 4, 1990

[54] HEATING DEVICES

[75] Inventors: Peter H. A. Roebuck, Bankfoot; Stanley B. Moug, Ruthvenfield; Adrian G. Howgate, Perth, all of Scotland

[73] Assignee: Kanthal Limited, Inveralmond, United Kingdom

[21] Appl. No.: 63,832

[22] Filed: Jun. 19, 1987

[30] Foreign Application Priority Data

Jun. 20, 1986 [GB] United Kingdom ..... 8615162

[51] Int. Cl.[5] ..... H05B 3/44

[52] U.S. Cl. ..... 219/544; 219/541; 219/553

[58] Field of Search ..... 219/544, 541, 546, 345, 219/346, 543, 553

[56] References Cited

U.S. PATENT DOCUMENTS

| | | | |
|---|---|---|---|
| 3,479,490 | 11/1969 | Stark | 219/544 |
| 3,679,473 | 7/1972 | Blacthford et al. | 219/544 X |
| 3,781,528 | 12/1973 | Schrewelius | 219/544 X |
| 3,805,024 | 4/1974 | Joeckel | 219/553 |
| 3,839,623 | 10/1974 | Portmann | 219/544 X |
| 3,866,017 | 2/1975 | Keren | 219/390 |
| 3,870,463 | 3/1975 | Werych | 432/247 |
| 4,091,355 | 5/1978 | Beck | 338/286 |
| 4,164,646 | 8/1979 | Grise | 219/541 |
| 4,200,446 | 4/1980 | Koontz | 65/254 |
| 4,207,672 | 6/1980 | wohlert | 29/611 |
| 4,247,979 | 2/1981 | Eck | 29/611 |
| 4,278,877 | 7/1981 | Werych | 219/544 |
| 4,292,500 | 9/1981 | Semanaz | 219/345 |

FOREIGN PATENT DOCUMENTS

| | | |
|---|---|---|
| 0105175 | 4/1984 | European Pat. Off. . |
| 1110777 | 7/1961 | Fed. Rep. of Germany . |
| 1127512 | 4/1962 | Fed. Rep. of Germany . |
| 1540717 | 8/1969 | Fed. Rep. of Germany . |
| 3206508 | 9/1983 | Fed. Rep. of Germany . |
| 2007485 | 1/1970 | France . |
| 2301148 | 9/1976 | France . |
| 2499060 | 8/1982 | France . |
| 119302 | 3/1918 | United Kingdom . |
| 286355 | 2/1928 | United Kingdom . |
| 363708 | 12/1931 | United Kingdom . |
| 384834 | 12/1932 | United Kingdom . |
| 418155 | 10/1934 | United Kingdom . |
| 1114984 | 5/1968 | United Kingdom . |
| 1217056 | 12/1970 | United Kingdom . |
| 1233469 | 5/1971 | United Kingdom . |
| 1350574 | 4/1974 | United Kingdom . |
| 1441577 | 7/1976 | United Kingdom . |
| 1593903 | 5/1981 | United Kingdom . |

*Primary Examiner*—Bruce A. Reynolds
*Assistant Examiner*—Marvin M. Lateef
*Attorney, Agent, or Firm*—William R. Hinds

[57] ABSTRACT

A heating panel includes an electrical heating element fully embedded in a base of refractory material, the element being embedded in a region of high thermal conductivity refractory material integrally backed by low thermal conductivity refractory material. The element and surrounding high-thermal conductivity refractory may be fully or partially raised above the general surface of the base. In another aspect, a heating device is in the form of an electrical heating element coil supported and retained on a base of castable refractory material by ribs molded with the base and around part of the periphery of the coil, the material of the base being molded between adjacent turns of the coil, the core of the coil being free of refractory and open to the surface of the device, and at least part of the coil periphery is raised above the surrounding surface of the panel. Methods of making the heating device are disclosed.

8 Claims, 2 Drawing Sheets

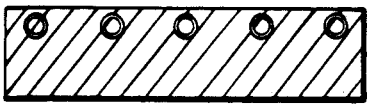
PRIOR ART FIG.1
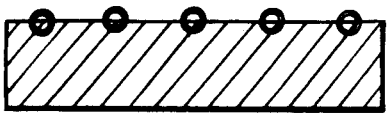
PRIOR ART FIG.2
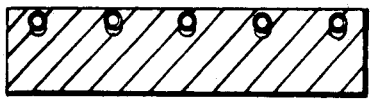
PRIOR ART FIG.3
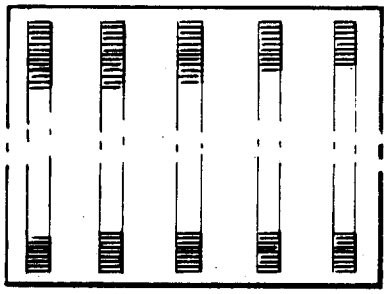
PRIOR ART FIG.4
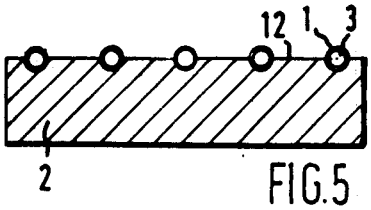
FIG.5
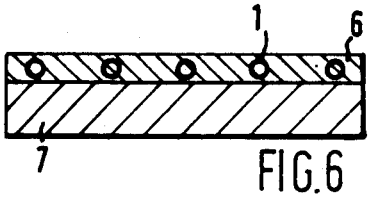
FIG.6
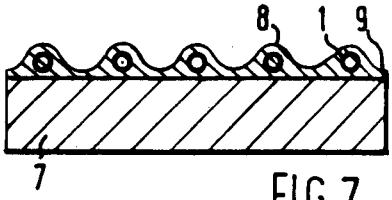
FIG.7
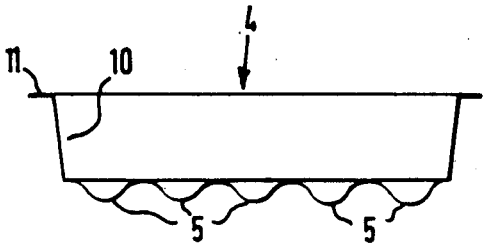
FIG.8

HEATING DEVICES

This invention relates to electric heating devices in which an electric resistance heating element is fully or partially embedded in a refractory base. Such devices are made as plane panels, curved panels, muffles, or in more complicated geometries and the present invention is not restricted to any particular shape of device.

For simplicity the following description will refer to manufacture of plane panels, though the invention is not restricted to this geometry.

Electric heating panels have been made in the past by pressing a heating element, usually in the form of a coiled wire element, into a wet mix of, thermally insulating, castable refractory material which then sets around the element. The element is only partially pressed into the castable refractory material so that part of the coil is exposed and this form of panel is referred to as a "partially embedded panel".

An alternative form of panel is made by casting a thin layer of castable refractory material (of the kind used for partially embedded panels) into a mould, laying the coiled wire element on the castable refractory material, and then adding further castable refractory material so as to completely embed the element in the castable refractory material. Such panels are referred to as "fully embedded panels".

The moulds currently used are of simple form to suit the shape of the end product, (generally rectangular) and are made of wood or zinc coated steel.

Such panels are widely used in the construction of furnaces and as heaters in metallurgical processing.

These panels have a number of disadvantages. The fully embedded panel gives the element protection from e.g. metal splashes but because the element is embedded in an insulating refractory a temperature gradient exists between the element and the surface of the panel so that the effective surface temperature at which the panel can be used is below the maximum working temperature of the heating element. Higher temperatures can be obtained with the partially embedded panel, but the element is then exposed to the atmosphere and is vulnerable to metal splashes or corrosive gases; additionally the part of the element that is embedded in the thermally insulating panel will, in use, be hotter than the part of the element that is exposed and this can lead to failure of the element.

German Pat. Specification No. 3206508 discloses an open-cored coil of wire embedded in a ceramic panel, the core of the coil being open to the surface of the panel. The coil lies completely below the panel surface.

U.K. Pat. Specification No. 1441577 (Albert George Docx) proposes a heating panel for muffle furnaces comprising a coiled wire element fixed in a filter cast ceramic fibre base, the inside of the coil being substantially free of ceramic fibre, a gap being provided between the back of the coil and the ceramic fibre base. This construction has only part of the elements exposed to the surface, the gaps between windings being filled with ceramic fibres, (see page 2 lines 55–58 of specification).

U.K. Pat. Specification No. 1441577 also shows a second form of construction in which the core of the element is exposed to the surface, but this embodiment is made by cementing the coil into a channel in an existing panel and some of the cement can flow into the core of the coil covering the element in places, so leading to hot spots. Further a disadvantage of using ceramic fibre for open coil systems is that problems of creep arise at high temperature, the windings bunching and distorting.

The applicants have realised that to improve both radiant and convective heat transfer from a partially embedded panel it is advantageous to expose as much of the element as possible by reducing the amount of refractory surrounding the element at the front face of the panel to a minimum. Further they have realised that to lessen the risk of localised heating in fully embedded panels it is advantageous to have the heating element fully embedded in a region of thermally conductive, electrically non-conductive refractory backed by the thermally insulating refractory base. They have also realised that in a fully embedded panel it is advantageous to have the element raised in ridges of refractory above the general surface of the panel.

FEATURES AND ASPECTS OF THE INVENTION

Accordingly one aspect of the present invention provides a heating device comprising an electrical heating element in the form of a coil supported and retained on a base of castable refractory material by ribs moulded with the base and around part of the periphery of the coil, the material of the base being moulded between adjacent turns of the coil, the core of the coil being free of refractory and open to the surface of the device, part at least of the coil periphery being raised above the surrounding surface of the panel. The proportion of the periphery of the coil in contact with the refractory can be as little as 50%, though preferably greater than 60%, and yet the coil can still adhere well to the refractory base due in part to the refractory moulded between adjacent turns of the coil.

In a further aspect this invention provides a heating panel comprising an electrical heating element embedded in a base of refractory material characterised in that the element is fully embedded in a region of high thermal conductivity refractory material backed by low thermal conductivity refractory material. (Throughout this specification "low thermal conductivity" and "high thermal conductivity" are to be taken as relative terms only and do not imply an absolute value of thermal conductivity). The region of high thermal conductivity refractory material can comprise silicon carbide in a refractory matrix up to such a proportion that the bulk refractory is electrically non-conductive, e.g. up to 70%. Further refractories that can be used are oxide refractories such as e.g. magnesium oxide.

This invention further provides methods for forming heating devices as set out in the following description and as claimed in the appended claims.

DESCRIPTION OF THE DRAWINGS

The following description is by way of example only and refers to the drawings in which:

FIGS. 1–3 are sectional views of prior art heating panels;

FIG. 4 view of the heating panel of FIG. 2;

FIGS. 5–7 are sectional views of various heating panels falling within the present invention;

FIG. 8 is a view of a mould in accordance with one aspect of the present invention;

DESCRIPTION OF PREFERRED EMBODIMENTS

Figure 9:
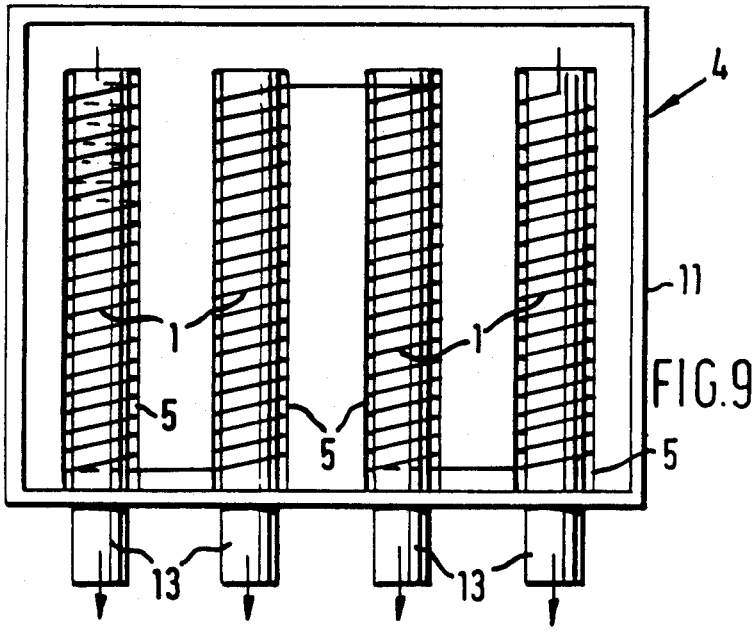
FIG. 9 illustrates a further method of making a panel in accordance with the invention and FIG. 10 shows such a panel.

FIG. 1 shows a fully embedded panel as described above formed from a castable refractory material.

FIGS. 2 and 4 show a partially embedded panel formed by the coil being partially pressed into wet castable refractory material.

In typical examples of this construction the wire heating element would be made of iron-chromium-aluminium alloy e.g. Kanthal (Trade Mark) Grade Al which has a manufacturer's nominal composition of 22% chromium, 5.8% aluminium, balance iron, or Kanthal (Trade Mark) Grade AF which has a manufacturer's nominal composition of 22% chromium, 5.3% aluminium, balance iron (all percentages being weight per cent).

The refractory material can comprise 2 parts mullite (—22 mesh), 1 part Secar 71 (Trade Mark) a hydraulic cement containing approximately 71% $Al_2O_3$, the balance being CaO.

Fully embedded panels of this form can be used up to furnace temperatures of around 1100° C. and partially embedded panels using these materials can be used up to approximately 1200° C. These temperatures correspond to element temperatures some 50° C. or more higher.

FIG. 3 shows a fully embedded panel as described in U.K. Pat. Specification No. 1441577. Performance figures for such a panel are not available.

FIG. 5 shows a panel according to one aspect of the present invention comprising a coil (1) of Kanthal Al or Kanthal AF wire supported by a refractory base (2) of castable material as described above, the core (3) of the coil being substantially free of ceramic. The coil (1) is held to the refractory base (2) by the ribs (12) moulded about the coil and by the refractory material moulded between adjacent turns of the coil (this also serves to prevent creep and bunching of the turns of the coil).

The proportion of the periphery of the coil (1) in contact with the refractory base can be as little as 50% although preferably greater than 60%, and yet the coil (1) can still maintain good adhesion with the base (2). It has been found in practice that use of Kanthal AF wire provides better resistance to creep than use of Kanthal Al wire but in any event the working temperature of such a panel can be as high as 1300° C., giving a furnace temperature of say 1270° C., a substantial improvement on existing fully embedded panels or partially embedded panels.

This form of panel is made using a mould (4) of similar form to that shown in FIG. 8; the mould having channels (5) in its base, the channels being disposed in the final geometry of the elements in the panel. The element (1) is either wound onto a former or a former is inserted through the core of the element (1). The former can be of cardboard or any other material that on heating the panel with burn or melt away. Petroleum Jelly or some other masking medium is placed in the mould channel (5) to mask those regions of the element (1) which are to be fully free of refractory material. The element (1) and its former are placed in the channels (5) of the mould (4). Refractory ceramic material is then poured into the mould, allowed to set, and the refractory, element, and former are then removed from the mould. Optionally, immediately after pouring the castable refractory into the mould, the mould may be vibrated to express trapped air and to settle the castable refractory. On heating the panel, either by passing current through the wire or passing the entire panel through a furnace, the former is burnt or melted away leaving the panel and element.

If the panel comprises several linked sections of coiled element (e.g. as in FIG. 4) the linking wires are preferably also exposed so as to avoid hot spots. This may simply be done by building up wax or some other masking medium on the mould to meet the linking wire and then casting. On firing the wax is lost exposing the wire.

FIG. 6 shows a further form of heating device in the form of a panel according to the present invention. The panel comprises a heating element (1) fully embedded in a layer (6) of thermally conductive, electrically insulating refractory material, in this case silicon carbide refractory comprising e.g. 70% silicon carbide, 30% refractory cement. This layer is backed by a thermally insulating layer (7) which may be of castable refractory material as previously described.

The panel is made by casting a layer of thermally conductive refractory, putting the element (1) in place, casting more thermally conductive refractory to cover the element (1), allowing this to set and then casting the thermally insulating refractory (7) to form a backing. Alternatively the procedure can be reversed, the backing being cast first. Use of a thermally conductive, electrically non-conductive layer results in improved heat transfer from the heating element to the surrounding refractory. This has several important advantages. Firstly, there is an increase in heating efficiency; this is made evident by the reduced back face temperatures given in Table 1 resulting from improved heat loss from the front face of the panel.

TABLE 1

Tests comprising using panels to heat a furnace to 1000° C.

| Panel | Front face Temperature | Back face Temperature |
|---|---|---|
| Standard Panel (FIG. 1) | 1036° C. | 882° C. |
| Silicon carbide front face (FIG. 6) | 1038° C. | 824° C. |

Secondly improved heat transfer results in a more even production of heat across the face of a panel (for a given furnace design) which may help to prolong the life of the elements (1) and also allow high temperatures to be reached with this fully embedded panel while remaining within the element manufacture's specified wire temperatures. For example a fully embedded panel using Kanthal Al wire and a silicon carbide refractory front face may be run at 1200° C. which is some 100° C. higher than the previously known fully embedded panels, and equals the temperature of the known partially embedded panels. In view of the protection given by embedding this is a substantial advantage.

To increase the radiative efficiency of this form of panel (or any fully embedded panel) the elements (1) may be partially or fully embedded in ridges (8) raised from the surface of the panel base. FIG. 7 shows the elements (1) fully raised in ridges (8) of thermally conductive, electrically insulating material. Such ridges (8) can either be raised from a layer of that same material (9) or can form separate islands on the thermally insulating backing (7). Such a panel can be made using the mould of FIG. 8 by casting a small amount of the thermally conductive refractory into the base of the channels (5), inserting the elements (1) into the channels (5), casting further thermally conductive refractory to embed the elements (1), and then casting the thermally insulating refractory (7) to form the backing.

The mould (4) is made of vacuum formed plastics material such as ABS (acrylonitrile butadiene styrene). The material has to be sufficiently thick at its walls (10) to support the sideways pressure of the wet refractory mix and a suitable thickness is of the order of 2.4 mm. A peripheral flange (11) assists in giving resistance to deformation during moulding. Moulding these panels by using such a mould offers several advantages, firstly that the "hot" face of the panel has a smoother finish than existing products, secondly more complex profiles are possible and thirdly that the moulds are easily freed from the panel after casting.

Figure 10:
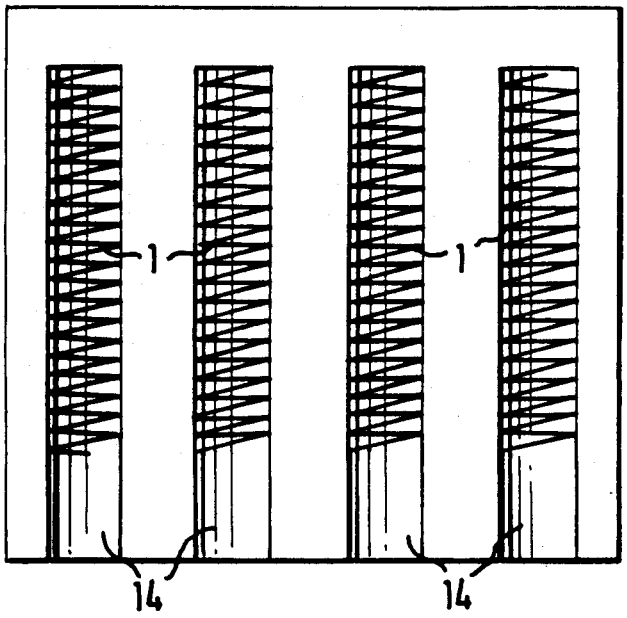

It is also possible to make such panels by using a mould similar to that of FIG. 8 but having holes at one end of each channel (5) to accept a plastic rod former (13) as shown in FIG. 9. The procedure followed is to place the element in the base of each channel (5); using a masking agent such as petroleum jelly as described above; insert plastic rods through the holes (not shown); cast the refractory into the mould; and when the refractory is partially set withdraw the plastic rods (13). This results in a panel as shown in FIG. 10 having recessed grooves (14) in line with the heating element coils.

Comparative tests have also been made between a panel as shown in FIG. 5 and as described above and a panel made with the open cored coil lying completely below the surface of the refractory, although open to said surface, i.e. as in German Pat. Specification No. 3206508. The panels were identical otherwise.

A pair of panels were used in each test, each panel being 152 × 152 × 25 millimetres, the panels were spaced 100 millimetres apart. Furnace insulation comprised 114 millimetre thick refractory bricks, the panels being backed by a 12 millimetre layer of ceramic fibre blanket. The temperatures of the element, panel front face, panel back face, and furnace cavity (i.e. the space between the panels) were measured. Details are given below of the results of these tests.

| Test A | Panel according to the invention (element above general surface of the refractory) |
|---|---|
| Element Temperature: | 1300° C. |
| Refractory front-face temperature: | 1292° C. |
| Refractory back-face temperature: | 1081° C. |
| Temperature difference: | 211° C. |
| Furnace temperature: | 1240° C. |
| Loading on panels: | 429 watts per panel = 858 watts total |
| Element life: | Panels tested for 672 hours. Test was terminated, with both elements still in good condition. |

| Test B | Panel with open cored element fully embedded just under general surface of refractory (prior art). |
|---|---|
| Element temperature: | 1300° C. |
| Refractory front-face temperature: | 1280° C. |
| Refractory back-face temperature: | 1122° C. |
| Temperature difference: | 158° C. |
| Furnace temperature: | 1250° C. |
| Loading on panels: | 431 watts per panel = 862 watts total |
| Element life: | Panel 1-5 hours<br>Panel 2-12.5 hours |

-continued

| | |
|---|---|
| | Average life - 8.75 hours |

From this it can be seen that:

(a) the temperature difference between back and front faces of a panel according to the invention is higher than that for a panel in which the open cored element is below the refractory surface. This means less energy is lost through the back of the panel. and (b) the lifetime of a panel according to the invention is higher than that for a panel in which the open cored element is below the refractory surface. This is believed to be due to improved radiation from the element and the higher front face temperature of the panels according to the invention support this.

We claim:

1. A heating panel comprising an electrical heating element fully embedded in a base of refractory material, the element being embedded in a region of high thermal conductivity refractory material integrally backed by low thermal conductivity refractory material.

2. A heating panel as claimed in claim 1 in which the region of high thermal conductivity comprises silicon carbide in a castable refractory matrix.

3. A heating panel as claimed in claim 1 in which the element and surrounding high-thermal conductivity refractory is fully or partially raised above the general surface of the base.

4. A heating device comprising an electrical heating element in the form of a coil supported and retained on a base of castable refractory material by ribs moulded with the base and around part of the periphery of the coil, the material of the base being moulded between adjacent turns of the coil, the core of the coil being free of refractory material and open to the surface of the device, part at least of the coil periphery being raised above the surrounding surface of the panel.

5. A heating device as claimed in claim 4, comprising a plurality of linked coils, in which linking wires between the coils are exposed to the surface of the device.

6. A method of making a heating device as claimed in claim 4 comprising the steps of:

(i) forming a coil on a former within the coil (ii) taking a mould comprising one or more surfaces to define the heating device and channels in the surfaces to accept the coil (iii) placing the coil in the channels of the mould, masked parts of the coil being adjacent the channel surface (iv) filling the mould to the desired level with refractory material to form the base of the heating device (v) removing the heating device from the mould and (vi) removing the former and masking.

7. A method of making a heating device as claimed in claim 5 comprising the steps of:

(i) forming a plurality of coils on formers within the coils, linking wires between the coils linking them to form a continuous conductor (ii) taking a mould comprising one or more surfaces to define the heating device and channels in the surfaces to accept the coil (iii) placing the coil in the channels of the mould, masked parts of the coil being adjacent the channel surface (iv) building up wax or other masking medium from the mould to the linking wires (v) filling the mould to the desired level with refractory material to form the base of the heating device (vi) removing the heating device from the mould and (vii) removing the former and masking.

8. A method of making a heating device as claimed in claim 3 comprising using a mould comprising one or more surfaces to define the heating device and channels in the surface to define heating elements geometry, casting a layer of high-thermal conductivity refractory into the channels of the mould, placing the elements in the channels adjacent the layer of high-thermal conductivity refractory, casting high-thermal conductivity refractory to embed the element, and casting a backing layer of low thermal conductivity refractory.

* * * * *